US011428174B2

(12) United States Patent
Flowers

(10) Patent No.: US 11,428,174 B2
(45) Date of Patent: Aug. 30, 2022

(54) SYSTEM AND METHOD FOR CONTROL OF COMPRESSION IN INTERNAL COMBUSTION ENGINE VIA COMPRESSION RATIO AND ELASTIC PISTON

(71) Applicant: Lawrence Livermore National Security, LLC, Livermore, CA (US)

(72) Inventor: Daniel L. Flowers, San Leandro, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 17/168,933

(22) Filed: Feb. 5, 2021

(65) Prior Publication Data

US 2021/0254563 A1 Aug. 19, 2021

Related U.S. Application Data

(63) Continuation-in-part of application No. 17/040,065, filed as application No. PCT/US2019/023654 on Mar. 22, 2019.

(Continued)

(51) Int. Cl.
*F02D 15/04* (2006.01)
*F02B 75/04* (2006.01)

(Continued)

(52) U.S. Cl.
CPC ..... *F02D 15/04* (2013.01); *F02B 75/041* (2013.01); *F02D 35/02* (2013.01); *F02F 1/004* (2013.01);

(Continued)

(58) Field of Classification Search
CPC ..... F02B 75/041; F02F 1/004
See application file for complete search history.

(56) References Cited

U.S. PATENT DOCUMENTS 1,125,375 A * 1/1915 Netwon ..... F02B 75/041 123/73 V
1,429,164 A * 9/1922 Ramsey ..... F02B 75/041 123/48 C (Continued)

FOREIGN PATENT DOCUMENTS

CN 104727956 A * 6/2015 ..... F02B 75/04
KR 10-2019-0091351 A 8/2019

(Continued)

OTHER PUBLICATIONS

International Search Report and Written Opinion of the ISA issed in PCT/US2019/023654, dated Jul. 2, 2019; ISA/KR.

(Continued)

*Primary Examiner* — Kevin R Steckbauer
(74) *Attorney, Agent, or Firm* — Harness, Dickey & Pierce, P.L.C.

(57) ABSTRACT

The present disclosure relates to a system for controlling ignition of an air/fuel mixture intake charge directed into an internal combustion engine. The system may have a longitudinally movable inner cylinder liner configured to fit within a cylinder wall portion of an internal combustion engine, and able to receive a piston of the engine therein. A portion of the inner cylinder liner defines an internal volume forming a combustion chamber, and the internal volume controls a compression ratio of the cylinder. The system also has a cylinder head assembly operatively associated with the inner cylinder liner and able to move linearly to cause longitudinal displacement of the inner cylinder liner relative to the cylinder wall portion. This enables the volume of the combustion chamber to be further varied, to thus further vary the compression ratio.

20 Claims, 7 Drawing Sheets

Related U.S. Application Data

(60) Provisional application No. 62/647,167, filed on Mar. 23, 2018.

(51) Int. Cl.

| | |
|---|---|
| ***F02D 35/02*** | (2006.01) |
| ***F02F 1/00*** | (2006.01) |
| *F02B 75/02* | (2006.01) |
| *F02B 75/38* | (2006.01) |

(52) U.S. Cl.
CPC ..... *F02B 75/38* (2013.01); *F02B 2075/025* (2013.01)

(56) References Cited

U.S. PATENT DOCUMENTS

| | | | | |
|---|---|---|---|---|
| 3,205,878 | A | 9/1965 | Timour et al. | |
| 4,016,841 | A | 4/1977 | Karaba et al. | |
| 4,104,995 | A | 8/1978 | Steinbock | |
| 4,144,851 | A * | 3/1979 | Prosen | F02B 75/041 123/78 AA |
| 4,148,284 | A * | 4/1979 | Prosen | F02B 75/041 123/78 AA |
| 4,372,256 | A | 2/1983 | Firey | |
| 4,873,947 | A * | 10/1989 | Ryan, III | F02B 75/041 123/90.31 |
| 5,769,042 | A | 6/1998 | Popadiuc | |
| 5,934,228 | A * | 8/1999 | Wheat | F02B 75/041 123/48 C |
| 7,318,397 | B2 * | 1/2008 | Ward | F02B 75/048 123/197.1 |
| 9,239,003 | B1 * | 1/2016 | Manke | F01L 7/04 |
| 9,410,489 | B2 * | 8/2016 | Miyazono | F02D 15/02 |
| 2003/0136358 | A1 | 7/2003 | Galvin | |
| 2006/0005793 | A1 * | 1/2006 | Ward | F02B 75/04 123/48 B |
| 2010/0154749 | A1 | 6/2010 | Barberato | |
| 2011/0192370 | A1 | 8/2011 | Wang | |
| 2012/0305354 | A1 | 12/2012 | Preukschat et al. | |
| 2014/0165963 | A1 | 6/2014 | Langham | |
| 2015/0167562 | A1 * | 6/2015 | Kim | F02B 75/04 123/48 C |
| 2015/0176506 | A1 * | 6/2015 | Miyazono | F02F 1/26 123/48 A |
| 2015/0252197 | A1 | 9/2015 | Ershad Langroudi et al. | |
| 2016/0312693 | A1 * | 10/2016 | Brevick | F02P 5/145 |
| 2018/0252197 | A1 * | 9/2018 | Glugla | F02P 5/1527 |
| 2020/0408145 | A1 | 12/2020 | Johansson | |
| 2021/0025322 | A1 * | 1/2021 | Killingsworth | F02D 15/04 |
| 2021/0254563 | A1 | 8/2021 | Flowers | |

FOREIGN PATENT DOCUMENTS

| | | | |
|---|---|---|---|
| WO | WO-0009871 | A1 | 2/2000 |
| WO | WO-2019183521 | A1 | 9/2019 |

OTHER PUBLICATIONS

International Search Report and Written Opinion of the ISA issed in PCT/US2019/023654, dated Jul. 2, 2019; ISR/KR.

International Search Report regarding International Patent Application No. PCT/US2022/014880, dated May 16, 2022.

* cited by examiner

SYSTEM AND METHOD FOR CONTROL OF COMPRESSION IN INTERNAL COMBUSTION ENGINE VIA COMPRESSION RATIO AND ELASTIC PISTON

CROSS-REFERENCE TO RELATED APPLICATIONS

This application is a continuation-in-part application of U.S. application Ser. No. 17/040,065, filed Sep. 22, 2020, which claims priority from International Application No. PCT/US2019/023654, filed Mar. 22, 2019, which claims priority from U.S. Provisional Application No. 62/647,167 filed Mar. 23, 2018. The entire disclosure of each one of the above applications is hereby incorporated by reference into the present disclosure.

STATEMENT OF GOVERNMENT RIGHTS

The United States Government has rights in this invention pursuant to Contract No. DE-AC52-07NA27344 between the U.S. Department of Energy and Lawrence Livermore National Security, LLC, for the operation of Lawrence Livermore National Laboratory.

FIELD

The present disclosure relates to engine control/management systems for reciprocating piston driven engines, and more particularly to an internal combustion engine having a variable compression ratio device coupled with an elastic combustion chamber, for enabling an overall compression ratio of the engine to be adjusted in real time.

BACKGROUND

This section provides background information related to the present disclosure which is not necessarily prior art.

Reciprocating internal combustion engines are used throughout the world to convert chemical energy to mechanical energy in a wide assortment of applications. Such applications include, without limitation, cars, trucks, boats, generators, pumps, ATVs, snow machines, earth moving equipment, etc. Spark-ignited and diesel engines have prevailed during the last century; however, as emission standards have become more stringent, engines that employ low temperature combustion (LTC) strategies have dominated the focus of research labs and are trickling into production.

LTC relies on heavy dilution of the in-cylinder fuel/air mixture with excess air or recirculated exhaust gas. This dilution can lower the temperature of the air/fuel mixture within the cylinder during combustion. Ignition is typically initiated via the compression stroke of a piston. Typically, as the piston nears top dead center of its stroke, the air fuel mixture is compressed and its temperature rises. The compressed air/fuel mixture may be ignited using a spark plug or possibly even through just the heat built up during the compression stroke, such as with a diesel powered engine. This combustion process is very sensitive to the engine operating point, as well as to environmental conditions affecting the temperature of the ambient air being drawn in through the vehicle's intake manifold.

The efficiency of LTC engines is largely determined by the engine's compression ratio (the ratio of the largest in-cylinder volume to the smallest in-cylinder volume, over an engine cycle). Engine compression ratios are typically fixed and set as a compromise to be able to operate over a wide range of conditions. Engine efficiency could be improved if the compression ratio could be varied based on the momentary conditions.

A particularly difficult condition for LTC engines is starting when the engine walls are cold (i.e., after the engine has not been running for some time). Ideally under such conditions an engine would operate with a high compression ratio to ensure rapid ignition. However, the compression ratio of standard engines are limited to avoid abnormal combustion (i.e., excessively high combustion temperatures), excessive noise, and structural damage to the engine components that may occur under high engine loads.

Advances in automotive computational power and new actuator technologies allow adjustment of the "effective" compression ratio of the engine using variable valve technologies. The intake valve closing can be phased early (before the piston has reached bottom dead center ("BDC")) or late (after the piston has passed bottom dead center) reducing the amount of trapped intake charge. Both valve timing strategies reduce the pressure at the start of the compression stroke of the piston. At the end of the compression stroke, the pressure and temperature are reduced, compared to what would be seen with conventional valve timing, because the charge is not compressed through the entire geometric compression (i.e., the full stroke of the piston from BDC to top dead center ("TDC")). These strategies reduce the amount of trapped intake charge-comprised of air and/or fuel, thus reducing the amount of power generated by the engine.

An alternative means of changing the effective compression ratio is the use of a surface within the engine cylinder that deflects as the pressure increases; effectively increasing the minimum volume and reducing the compression ratio. In practice this could be achieved using a plunger in the engine cylinder head or a two-piece piston with a compliant member connecting the top surface and the trunk (i.e., piston skirt) attached to the connecting rod. This idea has been the source of numerous patents beginning as early in the 20th century. However, the apparatuses described in these patents were all directed towards conventional spark ignited (SI) and diesel engines with the motivation of reducing the peak in-cylinder pressure to minimize the occurrence of knock, and increasing the compression ratio at part load in spark ignition (SI) engines.

Accordingly, there still exists a need in the art for even better and more robust control over the ignition process in an internal combustion engine, and more specifically an even more robust and advanced system and method for controlling a compression ratio of the engine, in real time, to optimize the combustion process.

SUMMARY

This section provides a general summary of the disclosure, and is not a comprehensive disclosure of its full scope or all of its features.

In one aspect the present disclosure relates to a system for controlling ignition of an air/fuel mixture intake charge directed into an internal combustion engine. The system may comprise a longitudinally movable inner cylinder liner configured to fit within a cylinder wall portion of an internal combustion engine, and able to receive a piston of the engine therein. A portion of the inner cylinder liner may define an internal volume forming a combustion chamber, and the internal volume may control a compression ratio of the cylinder. The system may also include a cylinder head assembly operatively associated with the inner cylinder liner and able to move linearly to cause longitudinal displacement of the inner cylinder liner relative to the cylinder wall portion. This enables the volume of the combustion chamber to be further varied, to thus further vary the compression ratio.

In another aspect the present disclosure relates to a system for controlling ignition of an air/fuel mixture intake charge directed into an internal combustion engine. The system may comprise a longitudinally movable inner cylinder liner configured to fit within a cylinder wall portion of an internal combustion engine, and adapted to receive a piston of the engine therein. A portion of the inner cylinder liner may define an internal volume forming a combustion chamber, and the internal volume controls a compression ratio of the cylinder. The system may further include a cylinder head assembly which is operatively associated with the inner cylinder liner and able to move longitudinally to cause longitudinal movement of the inner cylinder liner. This enables the volume of the combustion chamber to be further varied, to thus further vary the compression ratio. The system may also include a linear translation mechanism operatively associated with the cylinder head assembly. The linear translation mechanism controls a longitudinal position of the inner cylinder liner relative to the cylinder wall portion. The system may also include a dynamic displacement sensor operatively associated with the inner cylinder liner for sensing a longitudinal displacement of the inner cylinder liner. The cylinder head assembly and the inner cylinder liner include cooperating structure for securing each other together, while permitting a predetermined degree of longitudinal movement of the inner cylinder liner independently of the cylinder head assembly and while the cylinder head assembly is stationary.

In still another aspect the present disclosure relates to a method for controlling ignition of an air/fuel mixture intake charge directed into an internal combustion engine. The method may comprise arranging a longitudinally movable inner cylinder liner within a cylinder wall portion of an internal combustion engine, where a portion of the inner cylinder liner defines an internal volume forming a combustion chamber, and the internal volume controls a compression ratio of the cylinder. The method may further include coupling a movable cylinder head assembly to the inner cylinder liner, and controlling a longitudinal position of the cylinder head assembly relative to the cylinder wall portion to modify a longitudinal position of the inner cylinder liner, to thus controllably modify the volume of the combustion chamber, and to thus further vary the compression ratio.

In one aspect the present disclosure relates to a system for controlling ignition of an air/fuel mixture intake charge directed into an internal combustion engine. The system may comprise a movable component operably associated with at least one of a piston of the engine or a combustion chamber of the engine. The movable component may be tuned to deflect in response to a predetermined pressure being reached in the combustion chamber during movement of the piston within a cylinder of the engine, as the piston travels toward top dead center during its compression stroke, to change a compression ratio of the engine.

In another aspect the present disclosure relates to a system for controlling ignition of an intake charge directed into an internal combustion engine, where the engine has a piston moving axially within a cylinder, a portion of the cylinder and a portion of a cylinder head forming a combustion chamber, and the piston moves towards and away from the cylinder head. The system may comprise a movable component operably associated with at least one of the piston or the combustion chamber of the engine. A biasing is disposed in contact with the movable component to exert a biasing force on the movable component. The biasing force helps to control deflecting axial movement of the movable component in response to a predetermined pressure being reached in the combustion chamber during a compression stroke of the piston, to change a compression ratio of the engine.

In still another aspect the present disclosure relates to a method for controlling ignition of an air/fuel mixture of an internal combustion engine. The method may comprise configuring at least one of a piston or a portion of a combustion chamber of an engine with a movable component which is movable in response to a predetermined pressure being reached in a cylinder in which the piston is housed and moving axially in a reciprocating manner. The method further includes causing the movable component to deflect in response to the predetermined pressure being reached in the cylinder as the piston travels toward top dead center during a compression stroke. This influences compression developed within the combustion chamber, and thus a temperature of the air fuel mixture, to control ignition of the air/fuel mixture.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure. Corresponding reference numerals indicate corresponding parts throughout the several views of the drawings, in which.

Figure 8:
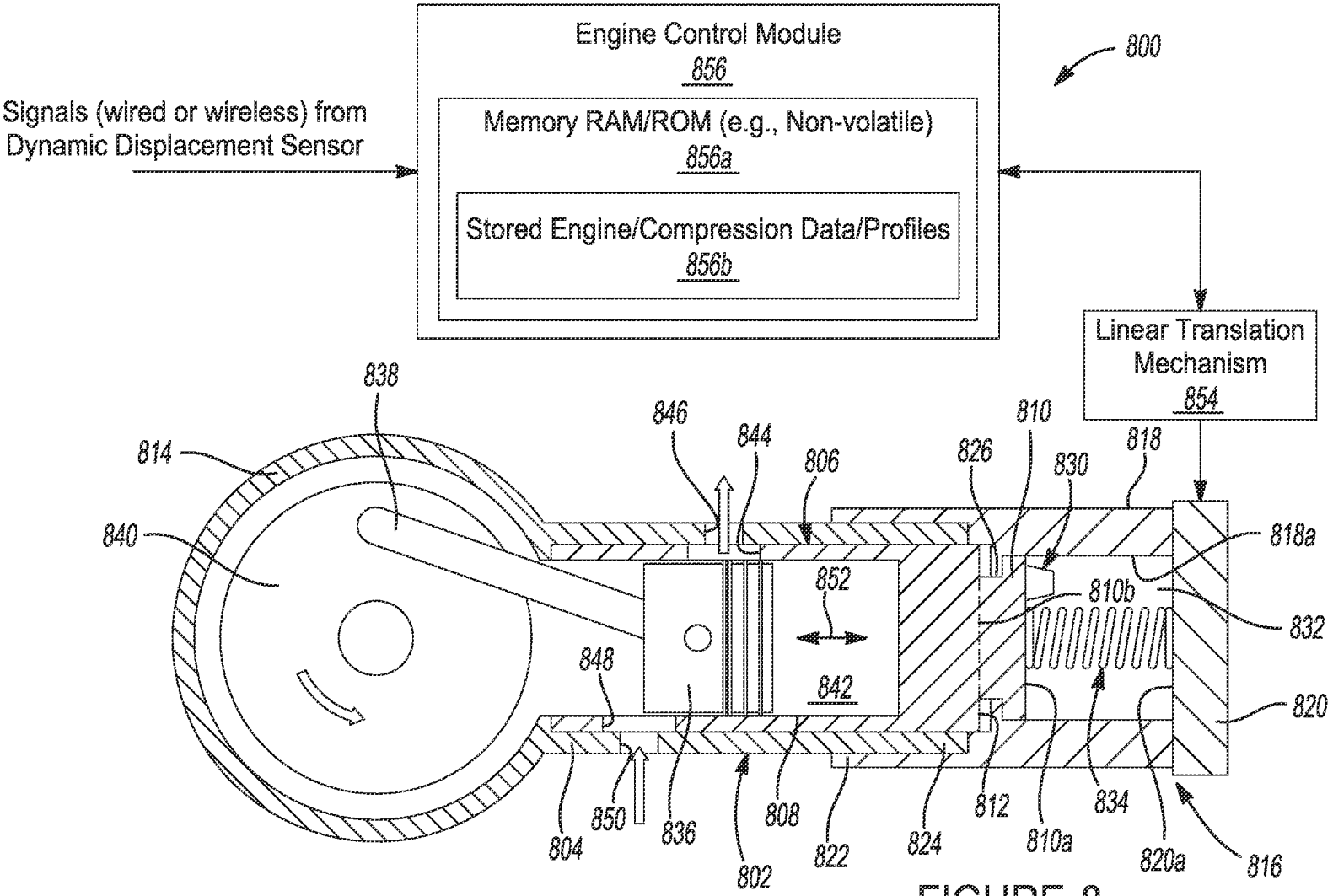
FIG. 8 is a high level side cross-sectional view of a system in accordance with another embodiment of the present disclosure, which implements an "elastic" cylinder construction to offer significantly enhanced, real time control over the compression ratio of an internal combustion engine.
Figure 9:
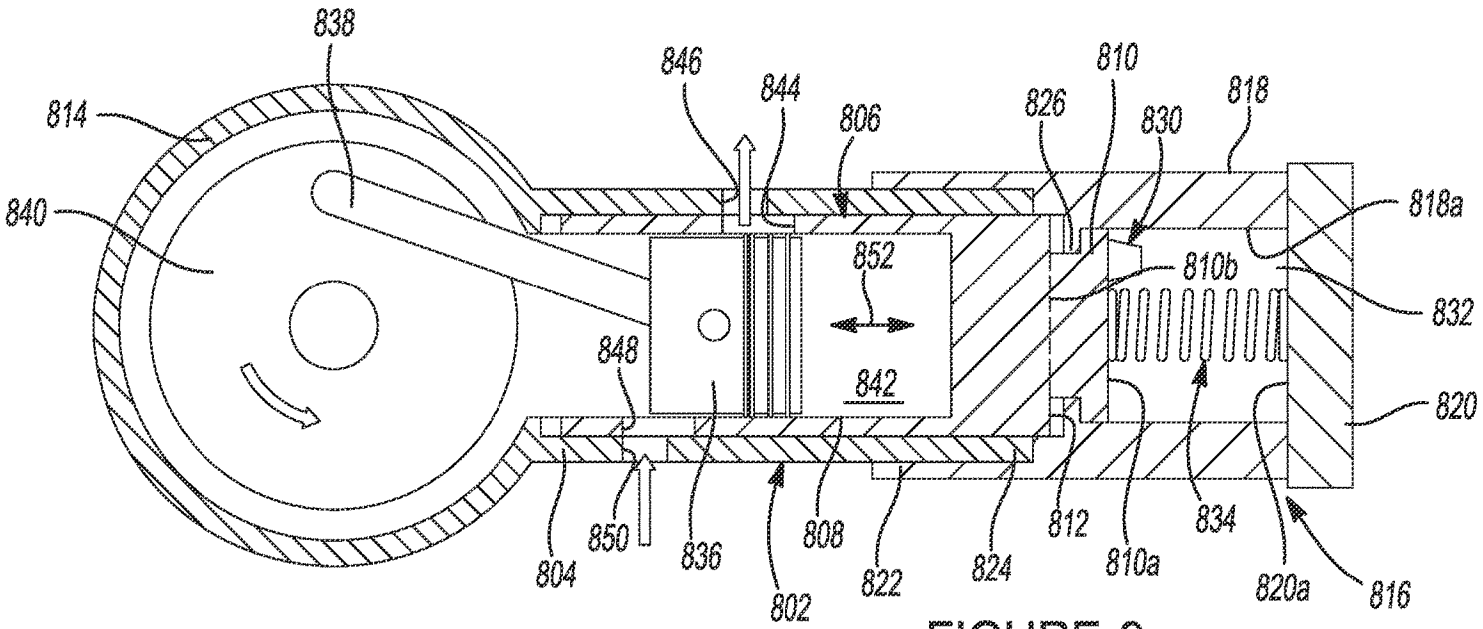
Figure 10:
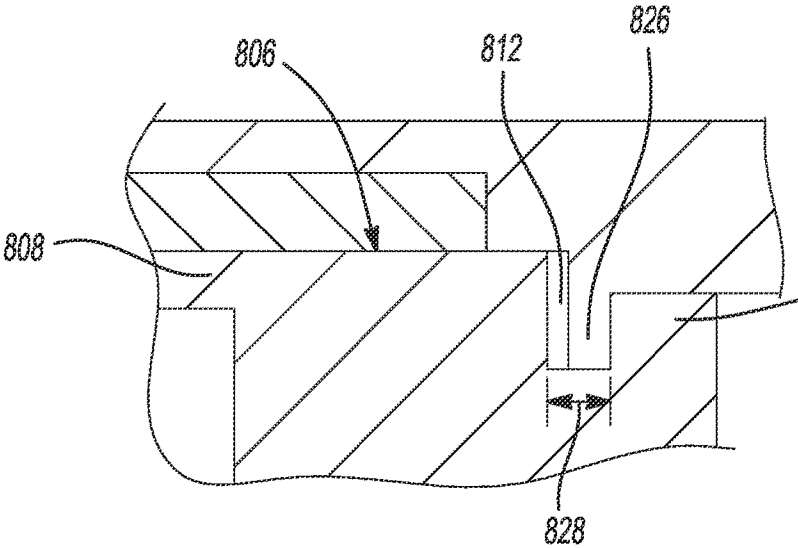

FIG. 9 shows the system of FIG. 8 but with a cylinder head assembly of the system in one extreme point of travel, to illustrate the significant increase that the system can provide in expanding the volume of the combustion chamber; and FIG. 10 shows a partial cross sectional view of a gap area of the system where a cylinder inner liner interconnects with a portion of the cylinder head assembly, which gap area allows a predetermined amount of response to changes in cylinder pressure in a rapid manner without involvement of an engine control module.

DETAILED DESCRIPTION

Example embodiments will now be described more fully with reference to the accompanying drawings.

The present disclosure is related to various embodiments of a movable or "deflecting" surface of a component of a spark ignited (SI) internal combustion engine which is used to alter a temperature of an in-cylinder air/fuel mixture within a combustion chamber of the engine during the combustion stroke of a piston. Thus, even though the peak pressure within the cylinder is essentially fixed, the temperature of the in-cylinder gas can be adjusted simply based on controlling pressure at the beginning of the compression stroke.

Figure 1:
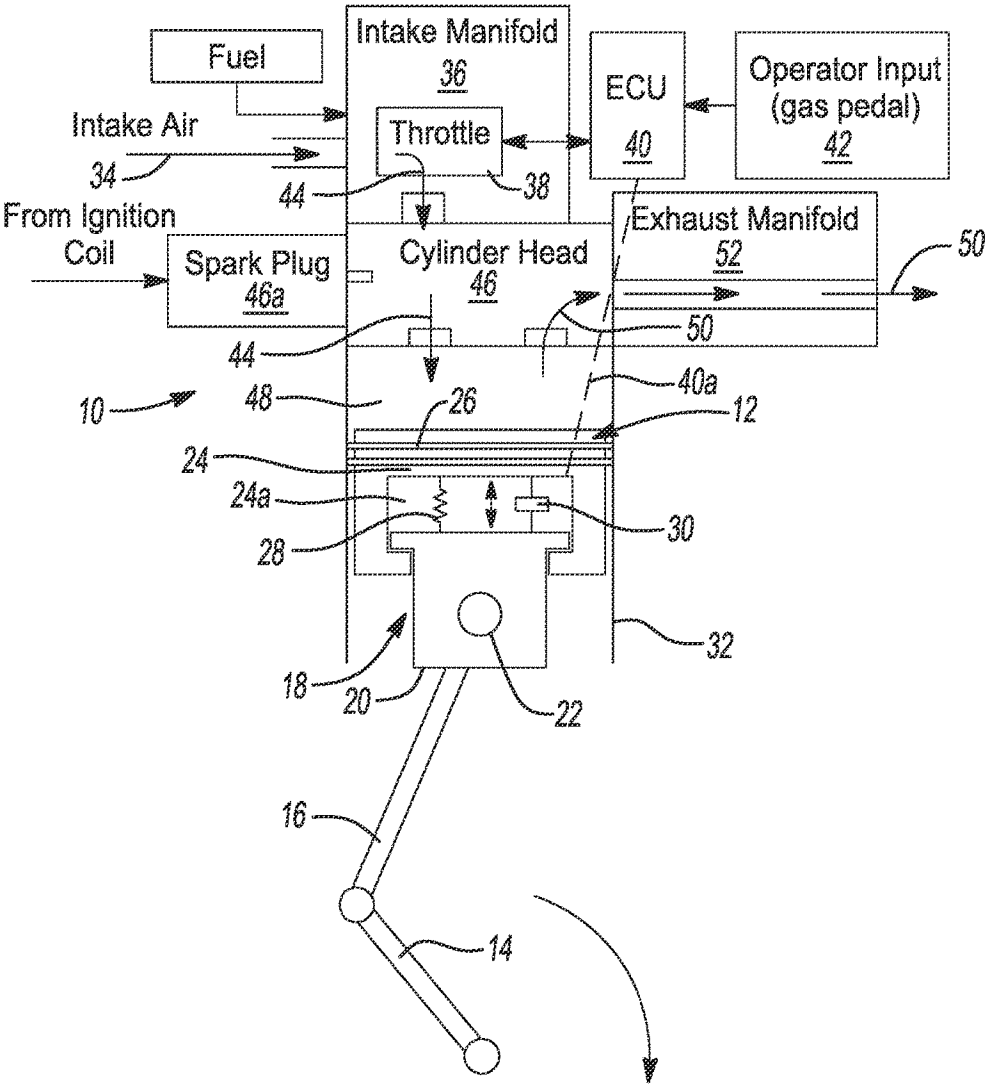
FIG. 1 is a high level block diagram of a cylinder of an internal combustion engine incorporating a movable, pressure responsive surface integrated into the construction of a piston, which may be used to control a compression ratio of an engine, and indirectly control the combustion timing of a combustible gas.

Referring to FIG. 1, a portion of an internal combustion, reciprocating piston engine 10 is shown. The engine 10 in this embodiment includes a piston 12 connected to a crankshaft 14 via a connecting rod 16. The connecting rod 16 is connected to a multi-piece skirt assembly 18 of the piston 12. A first portion 20 of the skirt assembly 18 connects to a distal end of the connecting rod via a wrist pin 22. A second portion 24 of the skirt assembly is coupled to the first portion 20 in what may be viewed as a sliding or telescoping manner. The second skirt portion 24 has a crown 26 which is used to compress the gas (air/fuel mixture) during the combustion stroke of the piston 12. At least one biasing component 28 is disposed within a cavity 24*a* formed by the second skirt portion 24, and between the first and second skirt portions 20 and 24, which tends to bias the second skirt portion 24 into a predetermined position when no pressure is acting on the piston 12. A principal feature of the piston 12 is therefore that the second skirt portion 12, and thus the crown 26, is able to move (i.e., deflect) freely relative to the first skirt portion 20 during the piston's compression stroke.

In FIG. 1 the biasing component 28 is shown as a coil spring, although alternatively other types of biasing structures could be used. For example, a Belleville washer could be used in place of, or possibly even in connection with the coil spring biasing component 28. A dashpot 30 can be added to provide damping and change the dynamics of the motion of second skirt portion 24 relative to the skirt assembly 18. Other options for providing a movable surface could be forming the crown 26 of the piston 12 as an engineered surface that is able to elastically deform in response to reaching a predetermined pressure. Such a surface may be made by forming the crown 26 using an additive manufacturing process. Other ways for implementing a deflectable surface may be, without limitation, the use of high temperature rubber for the crown 26 or possibly at least a section of the second skirt portion 24 of the piston 12. Still further, a pneumatic or hydraulic spring-like subsystem (shock absorber-like component), or even a torsional spring could potentially be integrated into the piston 12 to couple the motion between the second skirt portion 24 and the first skirt portion 20. As the second skirt portion 24 deflects, the spring angle will change and store energy. All of the above components enable energy storage to be achieved in response to increasing pressure on the piston 12.

Each of the foregoing implementations of a spring enable the crown 26 of the piston 12 to move independently relative to the first skirt portion 20 in response to the pressure experienced within a cylinder 32 of the engine 10, which in turn enables the pressure experienced by the air fuel mixture, and thus its temperature, to be controlled during the compression stroke. This enables the combustion timing of the engine 10 to be varied as needed to optimize efficiency and/or power produced by the engine. More particularly, the deflectable crown 26 enables the temperature of the air/fuel mixture to be controlled during the compression stroke of the piston 12, by controlling the compression ratio, which in turn allows the timing of combustion of the air/fuel mixture to be carefully controlled.

During operation of the engine 10, a quantity of ambient air 34 is ingested into an intake manifold 36 of the engine, possibly along with a quantity of fuel. The fuel could be direct injected as well. The intake manifold 36 may include a throttle 38 for controlling the quantity of fuel that is admitted into the intake manifold. The throttle 38 may be controlled by an engine control unit (ECU) 40 which receives a signal from an operator input 42 (i.e., gas pedal), or the throttle may receive the operator input signal directly from the input component 42. A combustible gas (i.e., air/fuel mixture) 44 is then formed by the mixture of a quantity of air and fuel which is charged into a cylinder head 46. The cylinder head 46 communicates with the cylinder 32 and helps to form a combustion chamber area 48, where the gas 44 is combusted via a spark produced by a spark plug 46*a* as the piston 12 approaches top dead center ("TDC") during its combustion stroke. It will be appreciated that TDC defines the upper limit of the piston 12 travel and bottom dead center ("BDC") defines the bottom limit of the piston travel. Exhaust gas 50 produced from the combustion process may be exhausted through an exhaust manifold 52 to the ambient environment or through other components (e.g., catalytic converter, muffler, etc.) before being released into the atmosphere.

As the piston 12 approaches TDC during the combustion stroke, the second skirt portion 26 may be deflected downwardly in the illustration of FIG. 1. The amount of downward deflection may depend on the pressure developed during the compression stroke, as well as other variables associated with the spring 28 and/or the dashpot 30, thus reducing the effective compression ratio of the engine 10 as the piston reaches TDC. The deflectable surface (i.e., the crown 26) of the piston 12 can thus be used to control combustion timing during the compression stroke.

If the spring 28 or dashpot 30 forms an actively controllable damper (e.g., hydraulic or pneumatic piston-like component), it may be directly controllable by, or may provide a feedback signal to, the ECU 40, as indicated by dashed line 40*a*.

Figure 2:
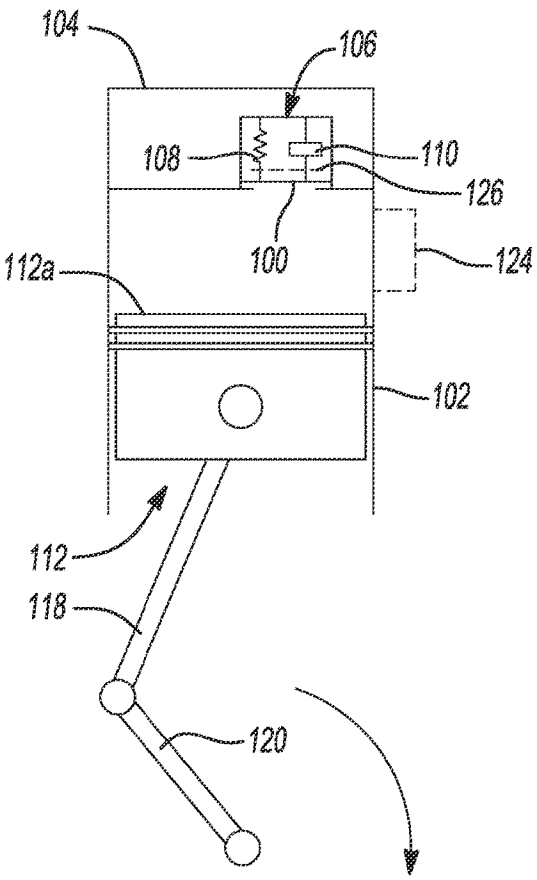
FIG. 2 shows an another embodiment of a movable, pressure responsive surface integrated into a combustion chamber, or alternatively into a wall of a cylinder forming a portion of the combustion chamber.

FIG. 2 illustrates another embodiment of the present disclosure in which the movable surface is achieved through the use of a movable element 100 disposed within a portion of a cylinder 102 or cylinder head 104 of an engine. It will be appreciated that the cylinder 102 and the cylinder head 104 may be used in connection with an engine such as described in connection with FIG. 1, but the various other components of the engine 10 described in connection with FIG. 1 have not been shown in the embodiment of FIG. 2.

The movable element 100 may be associated with a biasing subassembly 106 that includes the movable element 100 as well as one or more biasing elements 108 and/or 110 which provide a predetermined biasing force against which the movable element 100 works during the compression stroke of a piston 112. The biasing element 108 is shown as a coil spring in this example, while the biasing element 110 is shown as a pneumatic or hydraulic spring. All of the biasing options mentioned in connection with the components 28 and 30 are useable in the biasing subassembly 106 shown in FIG. 2. The biasing subassembly 106 of FIG. 2 may be used with an engine having a conventional piston 112 with a single piece construction where a crown 114 and a skirt portion 116 are formed as a single piece component. The piston 112 may be reciprocated via a conventional connecting rod 118 by a conventional crankshaft 120.

The biasing subassembly 106 may be integrated into the cylinder head 104. Optionally, the biasing subassembly may be integrated into a wall portion of the cylinder 102, as shown by dashed lines 124. Dashed line 126 shows how the movable element 100 may deflect away from a crown portion 112*a* of the piston during the compression stroke to reduce the compression ratio at TDC. The biasing subassembly 106 can therefore be used in the same manner explained above for the engine 10 to help control precisely when combustion occurs by controlling the pressure of the air/fuel mixture, and thus the temperature of the air/fuel mixture, during the compression stroke.

The movable surface (e.g., piston crown 26 or biasing elements 108/110) in the various embodiments discussed herein can be designed to deflect at a fixed pressure. When the intake pressure is high, such as when the throttle 38 is opened a large amount, or even wide open, the movable surface can be designed to deflect significantly during the compression stroke, resulting in a lower compression ratio. The intake air temperature is essentially fixed based on the ambient environment; therefore, the temperature of the air/fuel mixture 44 when the piston 12 is at TDC within the cylinder 32 decreases with a lower compression ratio. When the intake pressure is low, such as when the throttle 38 is open only a small amount, the movable surface 26 or 108/110 will deflect minimally as the piston 12 reaches TDC during its compression stroke, resulting in a higher compression ratio. The higher compression ratio yields a higher temperature at TDC for the air/fuel mixture 44 being combusted. Therefore, by controlling the throttle 38 in the intake manifold 36, the temperature of the air/fuel mixture 44 within the combustion chamber area 48 of the cylinder 32 can be quickly adjusted based on the effective compression ratio.

Alternatively, rather than using a throttle to control the intake pressure, the intake pressure may be adjusted using well known late and early intake valve closing strategies (e.g., variable valve timing), or a throttle positioned in an exhaust manifold could be used to retain residual exhaust gas. For turbocharged and supercharged engines, the compression ratio may be automatically adjusted based on the amount of boost being used, thus reducing the occurrence of knock and abnormal combustion.

This systems and methods disclosed herein for controlling the compression ratio and the in-cylinder temperature have significant implications for engines utilizing Low Temperature Combustion (LTC), as they can be readily implemented to control engine emissions and efficiency. The systems and methods of the present disclosure may also be used to enable multi-mode operation. For example, LTC modes may be implemented which require higher compression ratios, and which are used for low loads when the engine is throttled and/or with low boost pressures, while standard combustion modes may be used at higher loads where a lower compression ratio is desirable. The teachings of the present disclosure are also expected to aid significantly in starting the engine when the engine is cold.

The systems and methods of the present disclosure may also help to compensate for the effect of altitude on engines. It is well known that as an engine is operated at increasing altitude, atmospheric pressure decreases. The various embodiments of the present disclosure may be used to increase the compression ratio, and therefore the temperature of the air/fuel mixture, at TDC. This action compensates for the standard decrease in ambient temperature which typically accompanies an increase in altitude. The various embodiments of the present disclosure may thus increase the engine's efficiency by compensating for a decrease in trapped mass.

The various embodiments of the present disclosure may also improve part load efficiency since they operate to increase the compression ratio at lower loads when the intake charge is throttled. At higher loads, when abnormal combustion is more likely to occur, the pressure will be limited due to the movable crown 26 or movable component 108/110. Thus, the engine 10 can be built to withstand lower peak pressures, which can reduce the cost of the engine.

Still another benefit is that the movable crown 26 or movable component 108/110 may be used to help estimate the in-cylinder pressure through measurement of its displacement, or optionally through the use of a strain gauge. For example, the measured displacement of the piston crown 26 relative to the first skirt portion 20 may be used in a feedback control system to better control the efficiency of the engine (e.g., to further control the throttle 38 of the engine 10 or possibly even the valve timing, as indicated by dashed line 40*a* in FIG. 1).

And while the foregoing discussion has been centered around a spark ignited engine, it will be appreciated that the teachings of the present disclosure are not limited to use with only spark ignited engines, but may be applied to compression ignition engines, such as diesel engines, just as well.

The following is a partial list of ways additional ways in which a surface within the engine cylinder may be made to deflect under pressure and allow control of the in-cylinder temperature:

connecting rod that deflects axially under compression;

crankshaft that torsionally deflects;

movable smaller secondary piston within a main piston that deflects under pressure;

opposed cylinders each having a piston, where at least one of the pistons, or even both of the pistons in both cylinders, may deflect under a predetermined pressure;

a piston located within the cylinder head that can deflect under pressure;

a piston wrist pin, wrist pin bushing or wrist pin bearing that has compliance sufficient to produce a tangible, predetermined drop in the compression ratio in response to a predetermined pressure;

a fuel injector, a spark plug, or a glow plug that can physically move based on in-cylinder pressure to increase the cylinder volume, and thus decrease the compression ratio;

intake or exhaust valves that can physically move, based on in-cylinder pressure, to increase the cylinder volume, and thus reduce the compression ratio; and an engineered surface in the piston crown or in the combustion chamber of the cylinder head that elastically deforms in response to a predetermined pressure.

Figure 3:
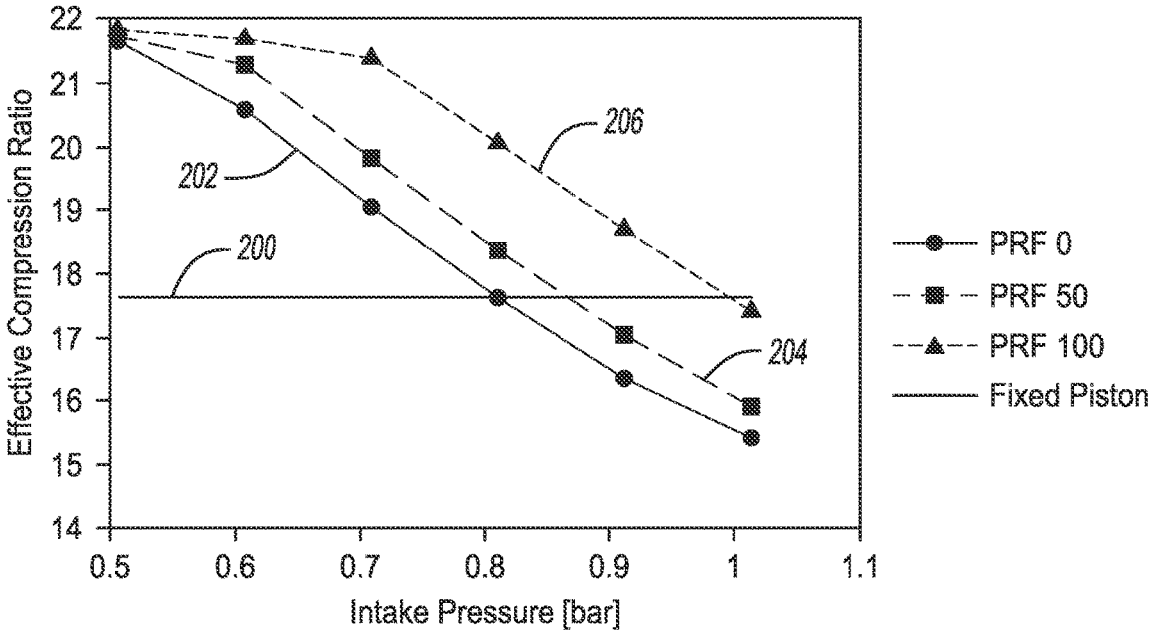
FIG. 3 is a graph illustrating the effective compression ratio versus intake pressure, and showing that for an engine with a deflecting surface, the effective compression ratio decreases as the intake pressure increases, resulting in lower in-cylinder temperatures as the piston reaches the top of its stroke.
Figure 4:
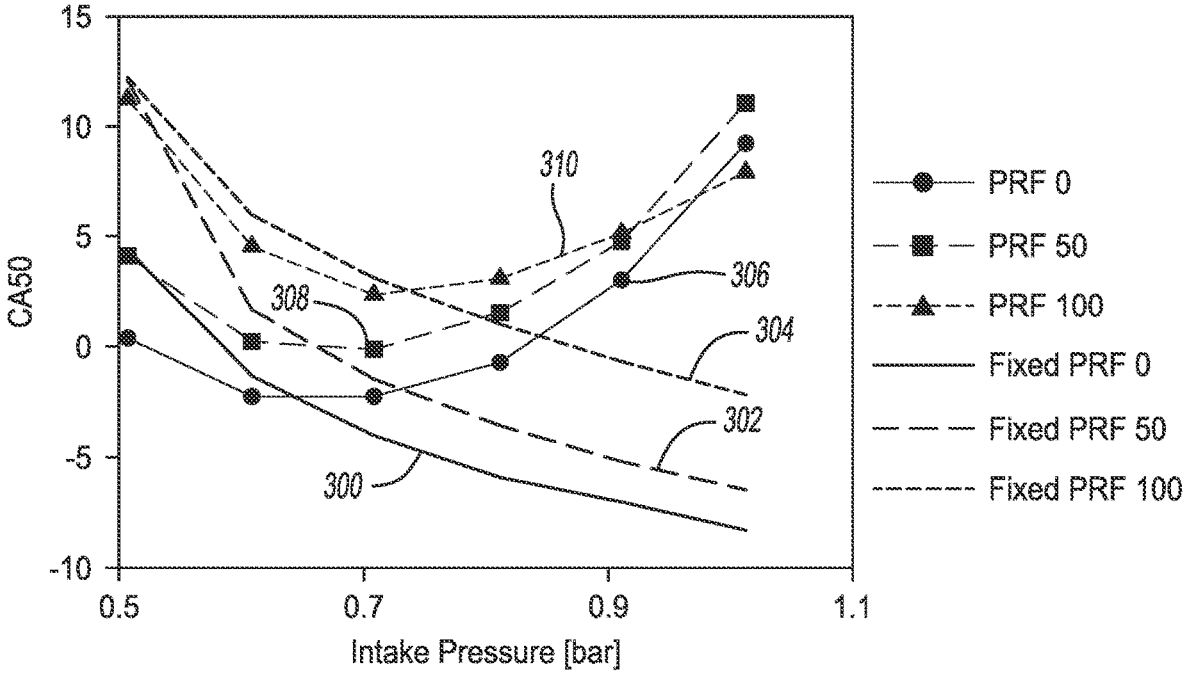
FIG. 4 is a graph showing an example of engine combustion timing versus intake pressure, and wherein the plots show that for a standard engine, as the intake pressure increases the combustion timing advances, and for an engine with a surface that deflects, the combustion timing advances at first but as the effective compression ratio decreases the combustion timing retards.
Figure 5:
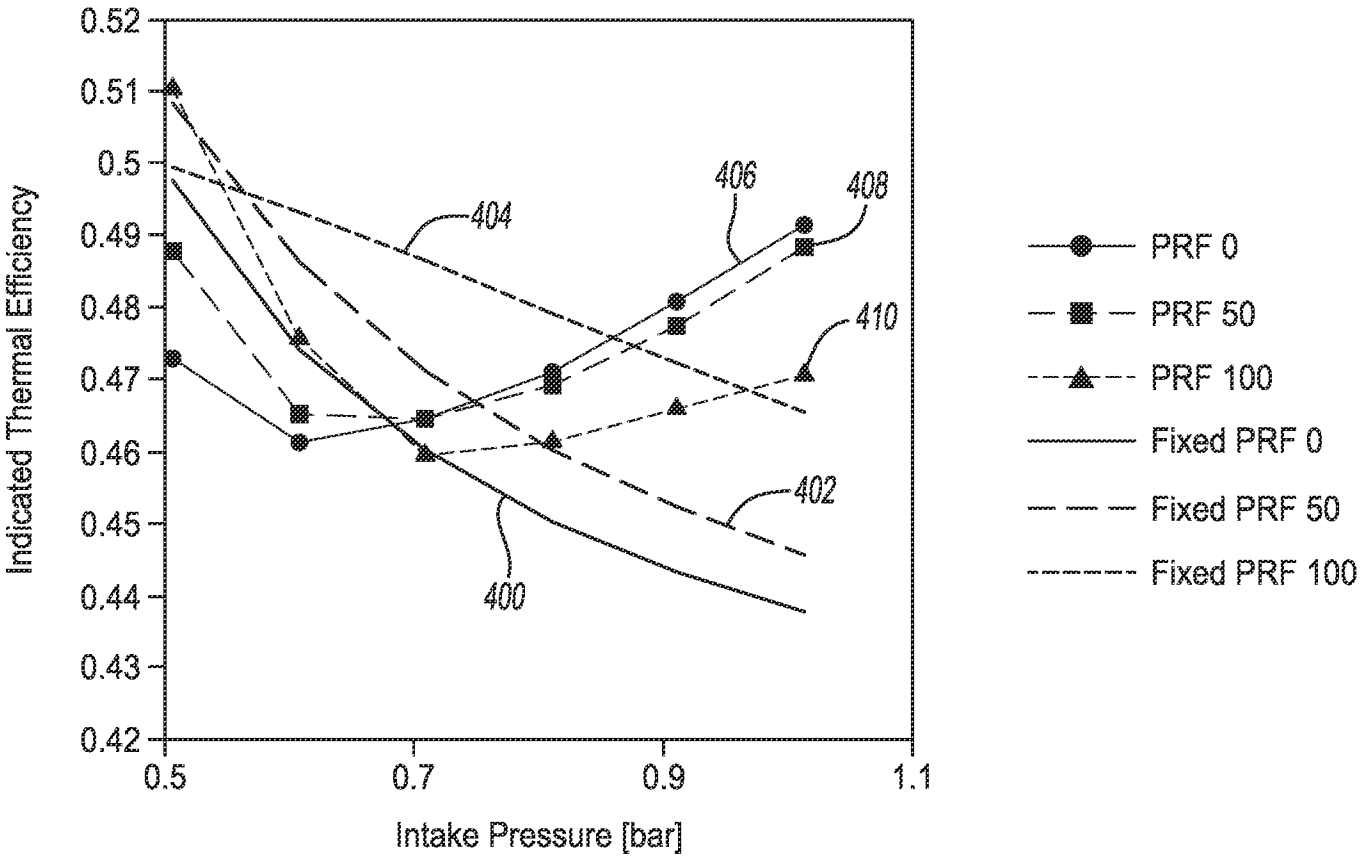
FIG. 5 is a graph showing indicated thermal efficiency versus intake pressure, and illustrating that for a standard internal combustion engine, as the intake pressure increases the combustion phasing is advanced before top dead center resulting in negative work and increased heat transfer.

FIGS. 3-5 pertain to the results of simulations of a standard engine and an embodiment of an engine with a deflecting surface which were run to demonstrate the latter's benefits. The deflecting surface was modeled as a spring mass damper system and thus the in-cylinder volume changes due to the dynamics of the deflecting surface which changes based on the in-cylinder pressure in addition to the slider crank piston motion. Both models use a zero-dimensional representation of the engine such that all gas within the engine cylinder is assumed to be at the same thermodynamic state. The model includes detailed chemical kinetics of the fuel and air. The fuel modeled is primary reference fuel (PRF): a mixture of n-heptane and iso-octane. N-heptane has an octane number of 0 and iso-octane an octane number of 100, where the octane number of a mixture is proportional to the volume of iso-octane. PRF 0 contains only n-heptane, PRF 50 contains 50% n-heptane and 50% iso-octane by volume and PRF 100 contains only iso-octane; therefore, a study of these three mixtures spans a broad range of ignition sensitivity.

FIG. 3 shows plots 200, 202, 204 and 206 of the effective compression ratio as the intake pressure is varied for three mixtures of PRF (plots 202-206), and a plot 200 of the compression ratio with a fixed piston (i.e., having no movable/deflectable surface). The effective compression ratio is the ratio between the maximum and minimum volume of the engine cylinder during the compression process and differs from the geometric compression ratio because of deflection of a movable/deflectable surface (such as surface 26 or components 108/110) and the intake valve close timing. The minimum volume increases as the intake pressure is increased, which decreases the effective compression ratio. These plots show that for an engine with a movable/deflectable surface, the effective compression ratio decreases as the intake pressure increases, resulting in lower in-cylinder temperatures as the piston reaches the top of its stroke and retarded combustion time (see FIG. 4). Combustion timing—as measured by the crank angle at which 50% of fuels heat has been released, CA50—slightly after TDC, tends to be optimal and result in peak efficiency. There is also a change in the effective compression ratio due to the fuel: a PRF 0 results in the lowest effective compression ratio for each intake pressure and as the PRF increases so does the effective compression ratio. PRF 0 is the most reactive fuel and ignites the earliest for both engine types as can be seen in FIG. 4. This early ignition results in heat release and a rise in pressure that causes the deflectable piston crown 26 or the movable element 100 to deflect and the in-cylinder volume to decrease relative to a standard engine having a piston with no movable/deflectable component. The least reactive fuel, PRF 100, ignites later and thus results in the highest effective compression ratio. This behavior is advantageous because less reactive fuels require higher temperatures to ignite, and thus this invention helps achieve the delayed combustion through self-regulation.

FIG. 4 shows a plurality of plots 300-310 to illustrate engine combustion timing (CA50) versus intake pressure. The plots 300-310 shows that for a standard engine with no movable/deflectable component associated with the piston or combustion chamber (plots 300-304), as the intake pressure increases the combusting timing advances. For an engine with a surface that moves or deflects in response to pressure (plots 306-310), the combustion timing advances at first but as the effective compression ratio decreases the combustion timing retards. There is more variation in CA50 for the fixed piston engine versus the engine with a surface that moves or deflects.

The indicated thermal efficiency for these cases is shown in FIG. 5 by plots 400-410. It can be noted that the efficiency of the standard engine (i.e., no movable or deflectable element with piston or combustion chamber) goes down with intake pressure, as shown by plots 400-404. However, with the use of a movable/deflectable component, the engine efficiency initially goes down for the engine but then increases, as shown by plots 406-410. For a standard engine, as the intake pressure increases the combustion phasing is advanced (see FIG. 3) before TDC, resulting in negative work and increased heat transfer, which serve to decrease the thermal efficiency. For the engine with a surface that moves/deflects, the combustion phasing does not advance as much, resulting in more efficient operation. Another important point of note is that the efficiency is highest for a PRF 100 for the standard engine (i.e., having no movable/deflectable component), but the engine with a movable/deflectable surface has the opposite trend, and the PRF 0 has the highest efficiency once the intake pressure is beyond 0.7 bar. This indicates that for this simulated embodiment, the engine with a deflecting surface is more efficient with a lower octane fuel rather than higher octane fuel, thus reversing the trend seen in modern day gasoline fueled, spark ignited engines.

Figure 6:
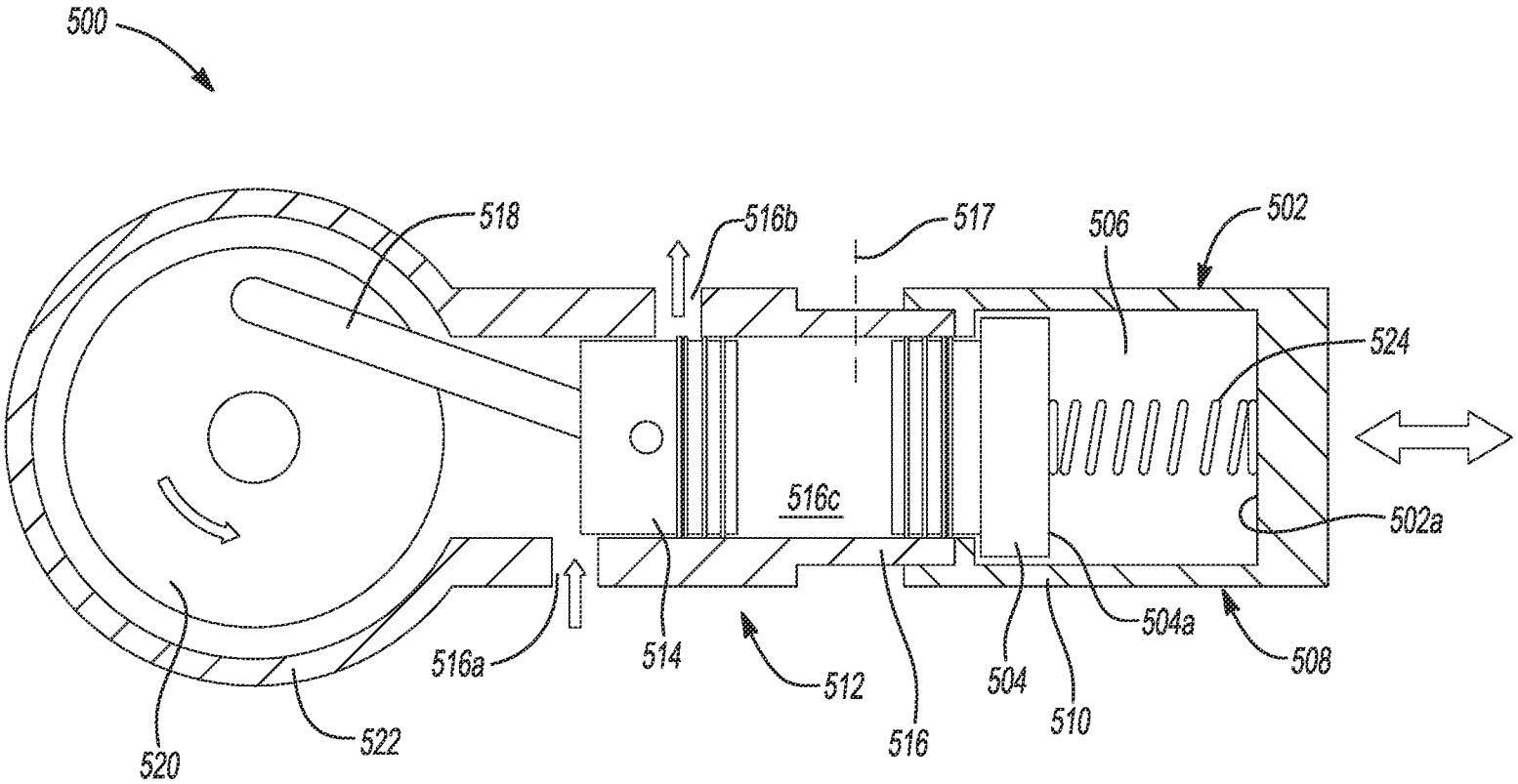
FIG. 6 is a simplified side cross sectional view of another embodiment of the present disclosure which incorporates a secondary piston forming a portion of a cylinder head assembly, which is able to move linearly a small amount to controllably modify a compression ratio.

Referring to FIG. 6, a system 500 is shown in accordance with another embodiment of the present disclosure. The system 500 in this example makes use of a cylinder head assembly 502 which includes a secondary piston 504 housed within an interior area 506 of a cylinder head component 508. The cylinder head component 508 includes a sleeve portion 510 which is fixedly secured to a portion of a cylinder block 512. A main piston 514 is positioned within a cylinder 516 of the cylinder block 512. Dashed line 517 indicates one suitable location where a spark plug may be located, where the spark plug projects into a combustion chamber area 516*c*. The main piston 514 is attached to a connecting rod 518 for reciprocating motion within the cylinder 516 via a crankshaft 520. The crankshaft rotates within a crankcase 522. The cylinder 516 includes an air/fuel mixture intake port 516*a* and an exhaust port 516*b*, both in communication with the combustion chamber area 516*c*.

Within the interior area of the head assembly 502 is a biasing component 524, for example a coil spring, leaf spring, an electrically controllable dashpot, or any other suitable form of biasing implement. In this regard the biasing component 524 may have a fixed spring rate, or if it is an electrically controllable component like a dashpot, it may have an electrically adjustable spring rate set via an electrical signal from a processor or controller which sends electrical control signals to the biasing component. The biasing component 524 is positioned with one end against an upper surface 504*a* of the secondary piston 504 and the other end against an interior surface 502*a* of the cylinder head assembly. The biasing component 524 provides a predetermined biasing force (adjustable in real time if an electronically controllable dashpot is used), which acts to modify the volume of the combustion chamber 516*c* within the cylinder 516, and thus the compression ratio when the piston is at TDC of its stroke.

Figure 7:
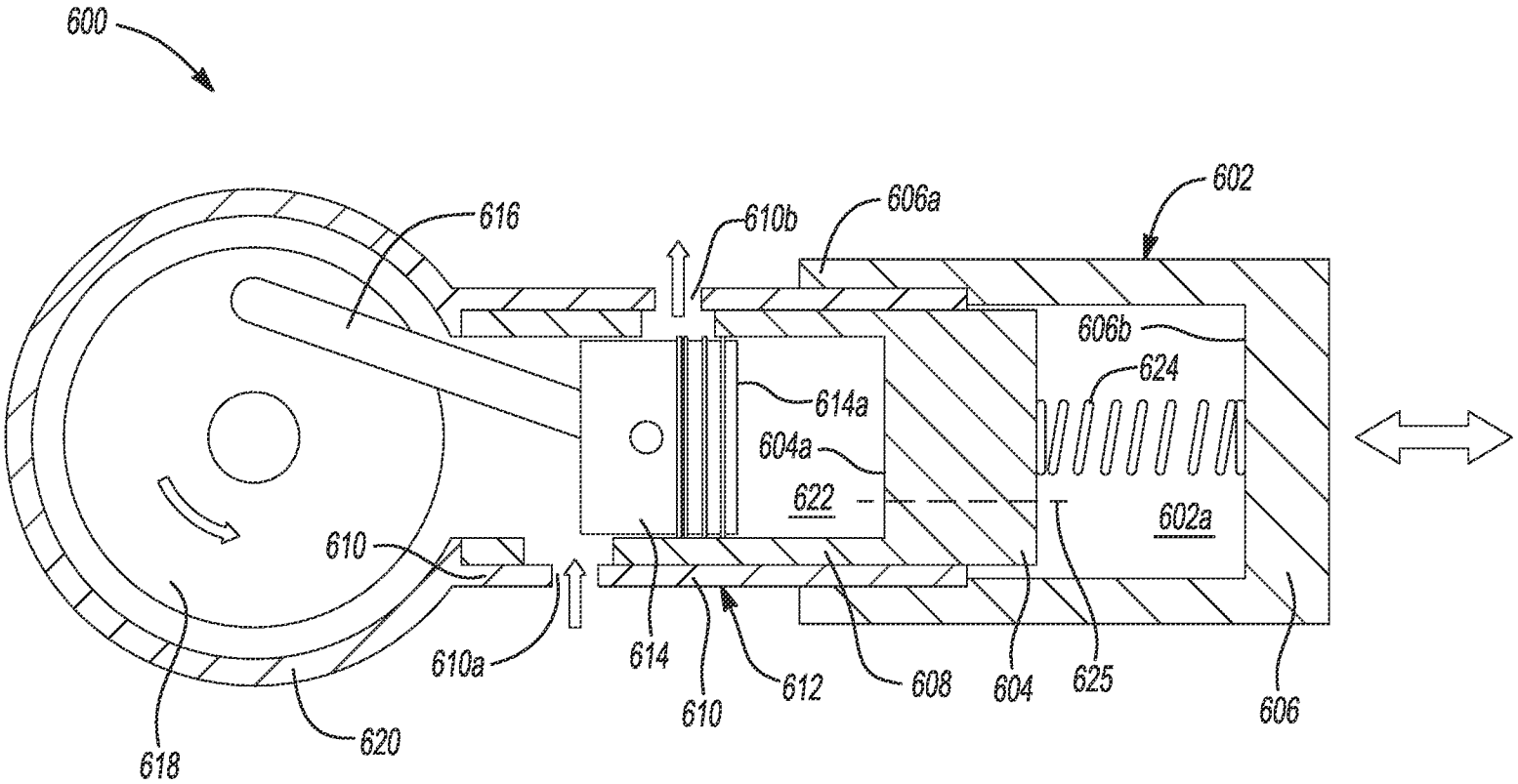
FIG. 7 is a simplified side cross sectional view of another embodiment of the present disclosure which incorporates a cylinder head assembly having a slidable internal liner that extends into the cylinder, and which is able to move linearly a small amount to modify a compression ratio.

Referring to FIG. 7, a system 600 is shown in accordance with another embodiment of the present disclosure. In this embodiment the system 600 includes a cylinder head assembly 602 having a slidable inner liner 604 disposed within a cylinder head component 606. The slidable inner liner includes a wall portion 608 which is dimensioned to fit within, and to slide within, a cylinder wall 610 of a cylinder block 612. An outer wall portion 602*a* of the cylinder head assembly 602 may be fixedly secured to a distal wall section 606*a* of the cylinder head component 606.

A piston 614 is positioned for reciprocating motion within the slidable inner liner 604. The piston 614 is coupled to a connecting rod 616 which is in turn connected to a crankshaft 618 that rotates within a crankcase 620. Rotational movement of the crankshaft 618 drives the piston 614 in a reciprocating manner. A combustion chamber volume 622 is formed above a head portion 614*a* of the piston 604 and the inner surface 604*a* of the slidable inner liner 604. An air/fuel intake port 610*a* and an exhaust port 610*b* may be formed at appropriate locations on the cylinder wall 610.

Positioned within an inner area 602*a* of the cylinder head assembly 602 is a biasing component 624. The biasing component 624 may be a coil spring, a leaf spring, an electronically controllable element such as an electronically controllable dashpot, or any other biasing implement. The biasing component 624 is positioned between an inner wall surface 606*b* of the cylinder head component 606 and an upper wall portion 604*b* of the slidable inner liner 604. The biasing component 624 is thus able to exert a counteracting force on the air/fuel mixture within the combustion chamber 622 as the piston 614 moves toward TDC during its compression stroke, and thus to control the compression ratio when the piston is at TDC. Again, if the biasing component 624 is an electrically controllable component, the then the compression ratio may be adjusted in real time through suitable control signals from a controller associated with the vehicle's engine. Dashed line 625 indicates one suitable location for a spark plug. With the system 600 of FIG. 7, it will be appreciated that movement of the slidable inner liner 604 may necessitate a flexible cable for the spark plug, as well as a pathway (not shown) for egress of the spark plug cable or a connection to the contactor, out from the heat assembly 602 to an ignition system. Optionally, a suitable sliding contactor may be used in place of a flexible spark plug cable.

Referring now to FIGS. 8 and 9, a system 800 in accordance with another embodiment of the present disclosure is shown. This embodiment implements a combustion control strategy using variable compression and an elastic combustion chamber to control compression ignition, such as for homogenous charge compression ignition. The system 800 is constructed to enable an engine to quickly adapt to different engine operating conditions or different fuels very quickly.

In this example, and with reference specifically to FIG. 8, the system 800 is shown integrated onto a single cylinder portion 802 of an engine block. But in practice, it is expected that internal combustion engines will incorporate the construction of the system 800 in each one of their cylinders. The system 800 may be coupled to a cylinder wall portion 804. The system 800 includes an inner cylinder liner 806 that is dimensioned to fit within the existing cylinder wall portion 804 of the engine, and is thus able to move longitudinally within the cylinder wall portion 804. The inner cylinder liner 806 includes a liner portion 808 and a head portion 810. The liner portion 808 and the head portion 810 are separated by a circumferential groove 812. The cylinder wall portion 804 is typically fixed secured or integrally formed with a crankcase portion 814 of an engine block of the engine, as is well known with present day internal combustion engines.

The system 800 also includes a fixed cylinder head assembly 816 having a sleeve portion 818 and a head portion 820. The sleeve portion 818 and the head portion 820 may be integrally formed as a single component or may be formed by two independent components secured together by suitable fasteners or other means (e.g., welding, brazing, etc.). The sleeve portion 818 includes a distal portion 822 having a diameter such that it fits closely over a distal end 824 of the cylinder wall portion 804 with minimal or no play.

With further reference to FIGS. 8 and 10, the sleeve portion 818 of the cylinder head assembly 816 also includes an inwardly projecting radial portion 826 which is captured in the circumferential groove 812 of the inner cylinder liner 806. In this regard, to facilitate assembly, it may be necessary to form the liner portion 808 and the head portion 810 of the inner cylinder liner 806 as separate components, such as at dashed line 810*b*, which are then fixedly joined together during assembly of the system 800. The longitudinal distance of the gap 812, as indicated by dimensional arrow 828 in FIG. 10, as well as the axial thickness of the inwardly projecting radial portion 826, enable a limited, predetermined amount of longitudinal movement of the inner cylinder liner 806 in response to rapid changes in pressure within a combustion chamber 842, to help maintain the internal pressure within the combustion chamber within a preset pressure range limit. In some embodiments the gap 828 may be up to a few millimeters in length, but the precise distance may depend on specific predetermined operating parameters for the engine that the system 800 is being used with. Accordingly, both the width of the gap 812 and the thickness of the inwardly projecting radial portion 826 influence the amount of longitudinal (i.e., linear) movement allowed for the inner cylinder liner 806 even if no movement of the cylinder head assembly 816 occurs. Therefore, both of these dimensions need to be taken in account when determining the needed amount of inner cylinder liner 806 longitudinal travel. The gap 812 performs an important function in enabling rapid but small adjustments in the compression ratio to maintain the pressure developed within the combustion chamber 842 within a relatively narrow, predetermined range during selected engine operating conditions. Put differently, the gap 812 enables a "first" degree of control over the compression ratio in real time, and in a highly rapid fashion. It will also be appreciated that by use of the term "longitudinal movement", it is meant movement along an axis extending parallel to an axial center of the bore of the cylinder wall portion 804.

Referring further to FIG. 8, the construction of the cylinder head assembly 816 can also be seen in detail. The controllably linearly translatable cylinder head assembly 816 provides an independent, second degree of control over the pressures developed in the combustion chamber 842 during operation of an engine incorporating the system 800. An outer surface 810*a* of the head portion 810, together with an internal circumferential wall 818*a* of the sleeve portion 818, define an internal volume 832 in which a dynamic displacement sensor 830 is positioned. The dynamic displacement sensor 830 senses longitudinal displacement of the head portion 810 (and thus the inner cylinder liner 806) relative to the cylinder head assembly 816. The dynamic displacement sensor 830 is fixedly secured to the outer surface 810*a* so that it travels longitudinally with the head portion 810 of the inner cylinder liner 806 during operation of the system 800. A suitable dynamic displacement sensor for use with the present system 800 is commercially available from a number of sources, for example and without limitation, Micro-Epsilon of Raleigh, N.C. or Omron Electronics LLC of Hoffman Estates, Ill. Still further, the dynamic displacement sensor may be a laser based sensor for detecting linear movement of the cylinder head 816.

The system 800 in this embodiment further includes a biasing element 834 disposed in the volume 832. The biasing element 834 abuts the outer surface 810 and an inner surface 820*a* of the head portion 820, to provide a biasing force against the head portion 810. The biasing element 834 is shown in this embodiment as a coil spring, but it just as readily may be formed by a leaf spring, a Belleville spring or any other suitable type of biasing spring. Still further, two magnets arranged with common poles facing one another could be disposed fixedly in the volume 832 to provide a continuous biasing force which biases the head portion 810 away from the head portion 820.

Positioned within the inner cylinder liner 806 is a piston 836. The piston 836 is coupled to a connecting rod 838, which is in turn coupled to a crankshaft 840 positioned within the crankcase 814. The piston 836, connecting rod 838 and crankshaft 840 do not form a part of the system 800, but reference is nevertheless made here to these components to help in providing a complete description of how the system 800 operates. As is well understood with operation of internal combustion engines, the rotational movement of the crankshaft 840 causes reciprocating linear motion of the piston 836. Volume 842 defines a combustion chamber area within the liner portion 808 of the inner cylinder liner 806. The inner cylinder liner 806 further includes an exhaust port opening 844 which registers with an exhaust port opening 846 in the cylinder wall 804 and permits exhaust gasses to be expelled from the combustion chamber 842 during a portion of piston 836 exhaust stroke travel during operation of the system 800. The liner portion 808 further includes an intake port 848 opening formed therein which communicates with an intake port opening 850 in the cylinder wall 804 during a select portion of intake stroke piston travel of the piston 836 to enable the intake of an air/fuel mixture, as is well understood with internal combustion engines.

The system 800 in one embodiment may be used to form a ported two-stroke engine that inducts premixed fuel and air. The compression ratio is varied by moving the inner cylinder liner 806 so that the head portion 810 moves along the longitudinal cylinder axis, denoted by arrow 852, closer to or further away from the TDC piston location. This longitudinal movement may be accomplished by a linear translation mechanism 854, which may comprise a linear actuator, a DC stepper motor and screw drive assembly, hydraulic actuator, stepper motor driven cam, wedge device, or any other suitable or like mechanism. Operation of the linear translation mechanism 854 may be controlled by an engine control module 856, or a separate dedicated controller, in response to signals from the dynamic displacement sensor 830.

In some embodiments the dynamic displacement sensor 830 may be an accelerometer. A closed loop controller may also be used with the system 800 to adjust/control the linear translation mechanism 854 so that the displacement of the accelerometer is held to a threshold level. This type of control may be done with low-cost, low-speed sensors. One could also use an in-cylinder pressure sensor to do a similar control, but this would require a more expensive, high speed measurement and control system. An important goal of the system 800 is to provide a system that is fuel flexible, clean burning, and does not require an expensive control scheme. Furthermore, it is possible that the system 800 could be manually adjusted with no electronic control based on noise made during operation (i.e., manually adjust the compression ratio to minimize clattering).

The engine control module 856 may incorporate a memory 856*a*, which may be formed by RAM or ROM or any other suitable electronically accessible data storage component. The memory 856*a* may incorporate a library 856*b* of stored engine/compression data/profiles that the engine control module 856 uses to control movement of the cylinder head assembly 816. The library may also include information determined from previously performed testing as to exactly how much linear movement is needed for the cylinder head assembly 816 to achieve or maintain a predetermined compression ratio under different engine operating conditions, and in response to data supplied by the dynamic displacement sensor 830. The control system may be able to respond via closed loop feedback control to adjust the cylinder head assembly 816 with information from the dynamic displacement sensor 830, or other such device that indicates the dynamic motion of the cylinder head assembly 816. A control system based on closed-loop feedback control from an in-cylinder combustion pressure sensor is another option that could be utilized.

During operation of an engine incorporating the system 800, the biasing element 834 allows for the volume of the combustion chamber 842 to be increased by a relatively small, predetermined amount during an engine cycle (i.e., in real time) to maintain pressure within the combustion chamber within a predetermined range. Thus, if pressure in the combustion chamber 842 increases beyond a preset level during a compression stroke of the piston 836, the compliance of the biasing element 834 allows the combustion chamber to effectively expand in volume by a relatively small, predetermined amount. This occurs as the biasing element 834 enables a degree of longitudinal movement of the inner cylinder liner 806 (i.e., toward the right in FIG. 8) in response to the excessive pressure in the combustion chamber 842. This longitudinal movement (i.e., displacement) helps to control, as well as limit, the maximum pressure developed within the combustion chamber 842 during a piston 836 compression stroke.

Since the dynamic displacement sensor 830 moves with the head portion 810 of the inner cylinder liner 806, the dynamic displacement sensor 830 is able to sense the amount of longitudinal displacement that the inner cylinder liner 806 experiences if the internal pressure within the combustion chamber 842 exceeds the preset threshold amount during the compression stroke cycle, and thus is able to send a signal (wired or wireless) to the engine controller 856 to apprise the engine controller of this condition. If a wireless signal is used, then the dynamic displacement sensor 830 may incorporate a suitable RF circuit for communicating wirelessly with the engine control module 856, and the engine control module may incorporate an RF receiver (or a separate RF receiver or transceiver may be used) to receive the wireless signal. Based on the measured dynamic longitudinal motion of the head portion 810, the engine control module 856 adjusts the overall compression ratio by a highly controlled longitudinal movement of the cylinder head assembly 816, using the linear translation mechanism 854, which is sufficient to alter the volume of the combustion chamber 842 to maintain the compression ratio at the preset target level (or within a preset target range).

With a two-stroke homogeneous charge combustion ("HCCI") engine application, the pressure, temperature, and fuel composition history controls when ignition will occur. At startup, the compression ratio of an engine may need to be very high because the engine is cold. As the engine warms up, the required compression ratio needed to sustain operation typically decreases. The system 800 is ideally suited to handle these very different engine operating conditions. For example, a cold engine may be started using a high compression ratio (e.g., with the cylinder head assembly 816 in the position shown in FIG. 8), while a small degree of elastic displacement of the inner cylinder liner 806 still being available due to the biasing element 834 and the gap 812. As the engine continues to run, and the wall temperature of the inner cylinder liner 806 increases, the elastic displacement of the cylinder head assembly 816 is preferably controlled using the linear translation mechanism 854 to allow a degree of longitudinal movement of the cylinder outer liner 818, and thus the entire cylinder head assembly 816, to reduce the maximum compression ratio (i.e., movement of the cylinder head assembly 816 toward the position shown in FIG. 9). Control may be achieved in one embodiment using the engine control module 856, which in some embodiments may use the library 856*b* of stored engine/compression data profiles to maintain the compression ratio within the combustion chamber 842 within a predetermined range of values during various engine operating temperatures and/or in response to other factors (e.g., sensed engine loads or external conditions affecting the vehicle). Changes in speed and load in a fully warmed-up engine are also expected to involve different compression ratios for optimal performance. Thus, one may configure the system 800, in one embodiment using suitable stored data from the library 856*b* of stored engine/compression data/profiles, to enable a "window" or predetermined range of desirable elastic displacement of the cylinder head assembly 816 to maintain stable or efficient engine operation. Additional parameters or data may also be programmed into the system 800 to provide for a minimum displacement (i.e., minimum compression ratio) selected/set to ensure that combustion is occurring, and a maximum compression ratio to ensure peak power for performance reasons.

It is expected that the range of needed longitudinal movement of the cylinder head assembly 816 may be dictated by a wide variety of variables, but in many cases may require about a few millimeters of travel to possibly 10 mm or more of longitudinal travel. The precise range of available longitudinal travel for the cylinder head assembly 816 may also vary with the type of engine being used. For example, marine engines may require significantly more than 10 mm of longitudinal travel of the cylinder head assembly 816 to accommodate varying operating conditions. The amount of travel will depend on the bore, stroke and maximum clearance volume of the engine, and the range of compression ratio adjustment desired (maximum clearance volume would be the lowest compression ratio for the engine). For example, an engine with a bore of 90 mm, stroke of 90 mm, and a maximum clearance volume of 101.8 $cm^3$ would need to travel 11.8 mm to achieve a range of compression ratio from 6:1 to 20:1. An engine with a bore of 1 m, stroke of 3 m, and a maximum clearance volume of 0.471 $m^3$ would need to travel 0.442 m to achieve a range of compression ration from 6:1 to 20:1.

It will also be appreciated that the system 800 may also make use of a pressure sensor in communication with an interior area of the cylinder, for example when also using a closed loop feedback control scheme for monitoring displacement of the head portion 810 and the inner cylinder liner 806. However, it is expected that the signals provided by the dynamic displacement sensor 830 will be sufficient for characterizing combustion adequately to control an engine.

The system 800 thus may provide optimal operation with a variety of different fuels, because the engine control module 856 may use its library 856*b* of available stored data and/or a closed loop feedback control system to adjust displacement of the cylinder head assembly 816 as needed to optimize engine performance, and also to accommodate a variety of fuels with different ignition characteristics (e.g., different octane ratings or chemical kinetic auto-ignition characteristics).

An important feature of the system 800 is that the "elastic" nature of the combustion chamber 842, that is, being able to be controllably changed in its effective length, in real time, to modify a compression ratio within the combustion chamber in real time, enables the system to provide a significantly different, variable compression ratio for different phases or conditions of engine operation. Importantly, the system 800 helps to avoid excess pressures in the combustion chamber 842 that might otherwise damage an engine making use of just a conventional variable compression ratio system.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A system for controlling ignition of an air/fuel mixture intake charge directed into an internal combustion engine, the system comprising:

a longitudinally movable inner cylinder liner configured to fit within a cylinder wall portion of the internal combustion engine, and able to receive a piston of the engine therein, a portion of the inner cylinder liner defining and varying an internal volume forming a combustion chamber, and the internal volume controlling a compression ratio of the cylinder; and a cylinder head assembly movable relative to the inner cylinder liner and able to move linearly relative to the cylinder wall portion to cause longitudinal displacement of the inner cylinder liner relative to the cylinder wall portion, to further vary the volume of the combustion chamber, to thus further vary the compression ratio.

2. The system of claim 1, further comprising a dynamic displacement sensor for sensing a longitudinal displacement of the inner cylinder liner.

3. The system of claim 2, wherein the dynamic displacement sensor is coupled to a portion of the inner cylinder liner and moves longitudinally with the inner cylinder liner.

4. The system of claim 3, further comprising a biasing element interposed between the inner cylinder liner and the cylinder head assembly, for providing a biasing force to urge the inner cylinder liner away and the cylinder head assembly in different longitudinal directions.

5. The system of claim 4, wherein the biasing element comprises a spring.

6. The system of claim 2, further comprising:

a control module operatively associated with the inner cylinder liner and responsive to signals from the dynamic displacement sensor for monitoring a longitudinal position of the inner cylinder liner; and a linear translation mechanism operatively associated with the cylinder head assembly for controllably moving the cylinder head assembly and the inner cylinder liner longitudinally.

7. The system of claim 6, wherein the control module includes:

a memory; and a data relating to stored engine/compression data and/or profiles for assisting the control module in controlling the linear translation mechanism to move the inner cylinder liner and the cylinder head assembly longitudinally in a controlled fashion.

8. The system of claim 1, wherein one of the inner cylinder liner or the cylinder head assembly includes a groove, and the other includes a radially projecting portion for engaging with the groove, and wherein the groove provides a predetermined amount of longitudinal travel of the inner cylinder liner relative to the cylinder head assembly.

9. The system of claim 2, further comprising a linear translation mechanism configured to move both the cylinder head assembly and the inner cylinder liner longitudinally, to change the volume representing the combustion chamber in response to signals received from the dynamic displacement sensor.

10. The system of claim 9, further comprising a dynamic displacement sensor operatively associated with the inner cylinder liner and with the cylinder head assembly, for sensing longitudinal movement of at least one of the inner cylinder liner or the cylinder head assembly.

11. The system of claim 10, further comprising a control module in communication with the dynamic displacement sensor for receiving signals transmitted by the dynamic displacement sensor, and for controlling longitudinal movement of the inner cylinder liner and the cylinder combustion chamber in response to the signals from the dynamic displacement sensor.

12. The system of claim 11, further comprising a biasing element interposed between the inner cylinder liner and the cylinder head assembly for biasing the inner cylinder liner and the cylinder head assembly in different longitudinal directions.

13. The system of claim 2, wherein the inner cylinder liner includes:

a liner portion; and a head portion; and wherein the dynamic displacement sensor is fixedly disposed on the head portion.

14. The system of claim 1, wherein the cylinder head assembly includes:

a liner portion; and a head portion.

15. The system of claim 14, wherein the liner portion of the cylinder head assembly is dimensioned to fit over the cylinder wall portion of the engine, and moves slidably longitudinally relative to the cylinder wall portion.

16. A system for controlling ignition of an air/fuel mixture intake charge directed into an internal combustion engine, the system comprising:

a longitudinally movable inner cylinder liner configured to fit within a cylinder wall portion of the internal combustion engine, and adapted to receive a piston of the engine therein, a portion of the inner cylinder liner defining an internal volume forming a combustion chamber, and the internal volume controlling a compression ratio of the cylinder;

a cylinder head assembly operatively associated with the inner cylinder liner and able to move longitudinally to cause longitudinal movement of the inner cylinder liner, to further vary the volume of the combustion chamber, to thus further vary the compression ratio;

a linear translation mechanism operatively associated with the cylinder head assembly for controlling a longitudinal position of the inner cylinder liner relative to the cylinder wall portion;

a dynamic displacement sensor operatively associated with the inner cylinder liner for sensing a longitudinal displacement of the inner cylinder liner; and the cylinder head assembly and the inner cylinder liner including cooperating structure for securing each other together, while permitting a predetermined degree of longitudinal movement of the inner cylinder liner independently of the cylinder head assembly and while the cylinder head assembly is stationary.

17. The system of claim 16, further comprising a control module responsive to signals from the dynamic displacement sensor, and in communication with the linear translation mechanism, for controlling movement of the cylinder head assembly and the inner cylinder liner in response to longitudinal movement of the inner cylinder liner.

18. The system of claim 17, further comprising a biasing element disposed between portions of the inner cylinder liner and the cylinder head assembly to provide a biasing force to counteract longitudinal movement of the inner cylinder liner.

19. The system of claim 16, wherein the cooperating structure includes a groove formed in one of the inner cylinder liner or the cylinder head assembly, and a radially extending portion formed on the other one of the inner cylinder liner or the cylinder head assembly, the groove and the radially extending portion cooperatively defining a predetermined available range of longitudinal motion for the inner cylinder liner while the cylinder head assembly is held stationary.

20. A method for controlling ignition of an air/fuel mixture intake charge directed into an internal combustion engine, the method comprising:

arranging a longitudinally movable inner cylinder liner within a cylinder wall portion of the internal combustion engine, a portion of the inner cylinder liner defining and varying an internal volume forming a combustion chamber, and the internal volume controlling a compression ratio of the cylinder; and coupling a movable cylinder head assembly to the inner cylinder liner, wherein the cylinder head assembly is movable relative to the inner cylinder liner, and the cylinder head assembly is also able to move longitudinally relative to the cylinder wall portion; and controlling a longitudinal position of the cylinder head assembly relative to the cylinder wall portion to modify a longitudinal position of the inner cylinder liner, to thus controllably modify the volume of the combustion chamber, and to thus further vary the compression ratio.

* * * * *